US010329713B2

(12) United States Patent
Engstrom et al.

(10) Patent No.: US 10,329,713 B2
(45) Date of Patent: Jun. 25, 2019

(54) METHOD AND ARRANGEMENT FOR GENERATING STEAM AT A DIGESTER PLANT OF A CHEMICAL PULP MILL

(71) Applicant: ANDRITZ OY, Helsinki (FI)

(72) Inventors: Johan Engstrom, Kauniainen (FI); Paivi Ketonen, Helsinki (FI); Peter Koistinen, Espoo (FI)

(73) Assignee: ANDRITZ OY, Helsinki (FI)

( * ) Notice: Subject to any disclaimer, the term of this patent is extended or adjusted under 35 U.S.C. 154(b) by 182 days.

(21) Appl. No.: 15/123,949

(22) PCT Filed: Mar. 4, 2015

(86) PCT No.: PCT/FI2015/050137

§ 371 (c)(1),
(2) Date: Sep. 6, 2016

(87) PCT Pub. No.: WO2015/132469

PCT Pub. Date: Sep. 11, 2015

(65) Prior Publication Data

US 2017/0016180 A1 Jan. 19, 2017

(30) Foreign Application Priority Data

Mar. 5, 2014 (FI) ..... 20145212

(51) Int. Cl.
*D21C 11/00* (2006.01)
*D21C 1/02* (2006.01)
(Continued)

(52) U.S. Cl.
CPC ..... *D21C 11/0042* (2013.01); *D21C 1/02* (2013.01); *D21C 7/10* (2013.01); *D21C 7/14* (2013.01)

(58) Field of Classification Search
CPC ..... D21C 11/0042; D21C 7/10; D21C 7/14; D21C 11/06; D21C 11/10; D21C 1/02
See application file for complete search history.

(56) References Cited

U.S. PATENT DOCUMENTS 4,239,603 A 12/1980 Egosi
4,551,198 A 11/1985 Wiley
(Continued)

FOREIGN PATENT DOCUMENTS

WO WO-2016038247 A1 * 3/2016 ..... D21C 7/10

OTHER PUBLICATIONS

Smook, Handbook for Pulp and PaperTechnologists, 1992, Angus Wilde Publications, 2nd edition, chapter 4. (Year: 1992).*
(Continued)

*Primary Examiner* — Anthony Calandra
(74) *Attorney, Agent, or Firm* — Nixon & Vanderhye P.C.

(57) ABSTRACT

The present invention relates to a method of producing steam at a digester plant of a chemical pulp mill. Black liquor is discharged from the digester at a first temperature and pressure. The black liquor is treated in a flash tank for generating flashed black liquor and flash steam at a second temperature and a second pressure, which are lower than the first temperature and pressure. The flashed black liquor is taken for further treatment to the evaporation plant. The flash steam is led to an indirect heat exchange contact with clean liquid in the reboiler for boiling the liquid and for generating steam. The steam is led from the reboiler into a fan or compressor for increasing the steam pressure to a third pressure, which is higher than the second pressure and for adjusting the pressure of the steam in the flash tank. Steam at a third pressure is used for pretreating comminuted cellulosic fiber material, such as chips, prior to cooking.

15 Claims, 1 Drawing Sheet

(51) Int. Cl.
*D21C 7/10* (2006.01)
*D21C 7/14* (2006.01)

(56) References Cited

U.S. PATENT DOCUMENTS

| | | | |
|---|---|---|---|
| 4,897,157 | A | 1/1990 | Elmore et al. |
| 6,176,971 | B1 | 1/2001 | Yu et al. |
| 6,346,166 | B1 | 2/2002 | Kettunen et al. |
| 2010/0224335 | A1 | 9/2010 | Tikka |
| 2010/0236733 | A1 | 9/2010 | Tikka et al. |

OTHER PUBLICATIONS

International Search Report cited in PCT/FI2015/050137, dated Jul. 1, 2015, 3 pages.

* cited by examiner

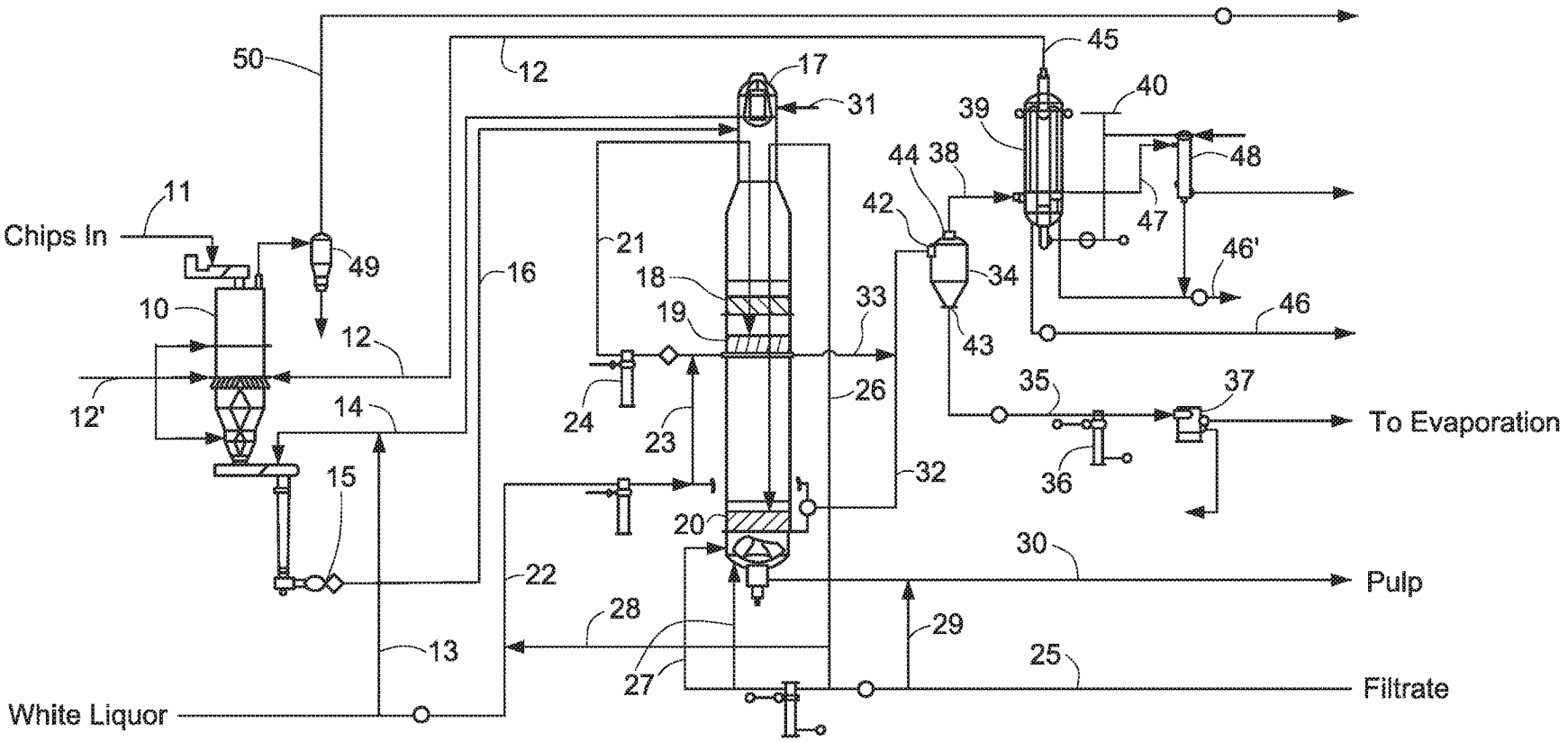
To Evaporation
Pulp
Filtrate
Chips In
White Liquor
10
11
12
12'
13
14
15
16
17
18
19
20
21
22
23
24
25
26
27
28
29
30
31
32
33
34
35
36
37
38
39
40
42
43
44
45
46
46'
47
48
49
50

METHOD AND ARRANGEMENT FOR GENERATING STEAM AT A DIGESTER PLANT OF A CHEMICAL PULP MILL

RELATED APPLICATIONS

This application is the U.S. national phase of International Application No. PCT/FI2015/050137 filed 4 Mar. 2015 which designated the U.S. and claims priority to FI 20145212 filed 5 Mar. 2014, the entire contents of each of which applications are hereby incorporated by reference.

BACKGROUND OF INVENTION

The present invention relates to a method and an arrangement for generating steam from black liquor at a digester plant of a chemical pulp mill.

Prior art utilizes a fiberline system with a chip bin, where wood chips or other cellulosic material is steamed and liquid is admixed therein for forming a suspension, after which the suspension is pressurized (this is also referred to as a feed system), fed into a treatment vessel or treatment vessels (which may be an impregnation vessel, a pre-hydrolysis process or other vessels), whereafter follows a digester (this part is also referred to as a cooking system). At present, at least one black liquor stream (typically at a temperature of 120-170° C.) is discharged from the cooking system. The extracted black liquor stream or streams is/are used as a heat source for "pre-heating" white liquor, other black liquor streams and/or other liquid streams being led to the feed and cooking systems. The discharged black liquor stream or streams is/are then led to a pre-evaporation system, i.e. to one or several flash tanks, wherein steam is generated from hot black liquor as it is cooled, typically to a temperature of approximately 100-120° C. After possible further cooling to 90-95° C. the black liquor is led to an evaporator system of the recovery area. The thus generated flash steam can be used at another location in the pulping process. Flash steam can e.g. be used for direct preheating of chips prior to cooking.

The above described flashing process, although being used successfully in conventional continuous digesters, has the disadvantage that the generated steam contains volatile compounds, including sulfur compounds, which are not desirable in wood chip presteaming. Typically, wood chips are steamed at atmospheric or slightly higher pressure so that residual gases are not absorbed into the wood chips, but they are collected and treated. The treatment is typically combustion in the non-condensable gas (NCG) system of the mill. This collection and treatment system becomes especially significant when the used steam contains volatile compounds, including sulfur compounds, which have a disadvantageous impact for the environment, including detrimental odor. Therefore, it is advantageous to use such a heat source that minimizes or eliminates the introduction of volatile compounds into the steaming process. In addition, an explosion risk exists, if concentrated gases entrained in flash steam are introduced into low concentration gases.

U.S. Pat. No. 6,722,130 discloses a system for producing clean steam from black liquor. First the pressure of the black liquor is decreased for producing a second black liquor having a higher concentration and black liquor steam, which is condensed to condensate. This condensate is heated with the first black liquor and flashed for producing clean steam to be used in a chip bin.

U.S. Pat. No. 6,176,971 discloses a system for producing clean steam for use in a chip bin. Substantially clean usable steam is produced from hot waste treatment liquor (e.g. black liquor) by leading the waste liquor to a reboiler and then pressurizing (e.b. by means of an eductor, fan or compressor) this clean steam discharged from the reboiler.

A further process for producing clean steam is disclosed in U.S. Pat. No. 6,306,252 for use in a chip bin, whereby black liquor obtained from a digester is led through a heat exchanger wherein clean process water is heated, after which the pressure of the heated process water is decreased, whereby clean steam is generated.

WO 2007073333 discloses a system and a method for producing steam at a digester plant of a chemical pulp mill. The pressure of hot pressurized black liquor obtained from the digester is decreased in a first stage for producing black liquor steam that is used for chip pretreatment in a second preheating stage. Clean steam for pretreating chips in the first preheating stage is generated by re-heating the black liquor, the pressure of which was decreased prior to the final subsequent pressure decrease, where the increased black liquor steam volume is led into a steam converter for producing clean steam.

Known solutions offer various systems for producing cleaner steam for the heating needs of a digester plant and for improving the energy economy of a chemical pulp mill.

SUMMARY OF INVENTION

The above solutions have often been used in the attempt to avoid using flash steam in a chip bin, because it causes odor problems and an explosion risk. Therefore reboiler solutions are favored, for instance a kettle reboiler or a vapor reboiler. A disadvantage of a kettle reboiler is that the dry solids content of black liquor does not increase therein. In a vapor reboiler the problem is that in certain cases this system is not always capable of producing an adequate amount of steam required in a chip bin, but it is inevitable to use low-pressure steam in the bin. This may take place by feeding live steam directly into the chips in the chip bin, whereby as the steam condenses, so-called boiler water is transferred into the chips and that way into the black liquor.

In a vapor reboiler solution, the black liquor is first flashed and the flash steam led into a reboiler, where water is reboiled for generating steam. This system may encounter a lot of resistance: in the piping, in the reboiler itself and in the chip bin. Then the pressure in the flash tank remains fairly high (even at a value of 100 kPa (g)). Then the temperature of the black liquor after flashing may be even higher than 120° C. The flashed black liquor usually has to be cooled by means of a cooler (liquid/liquid) prior to pumping to an evaporation plant. The higher the pressure in the flashing vessel, the higher the temperature of the black liquor and the lower the dry solids content, which causes increased steam consumption at the evaporation plant. Additionally, it is not possible to produce in the reboiler an adequate amount of steam into the chip bin, but it is inevitable to add low pressure steam therein. Direct use of steam decreases the dry solids content of black liquor both directly and indirectly by increasing the liquid to wood (L/W) ratio.

An object of the present invention is to avoid the above mentioned problems and to provide an improved and alternative method of producing clean steam for steam pretreatment of wood chips by utilizing the heat of black liquor as efficiently as possible and by decreasing the use of live steam. Another object is to produce steam by means of black liquor so that the properties of treated black liquor are improved for further treatment at the recovery area of a chemical pulp mill. One object is also to improve the overall energy economy of a chemical pulp mill.

The method and arrangement for achieving these objects are defined in the appended claims.

The present invention relates to a method of producing steam at the digester plant of a chemical pulp mill, in which method a) the suspension formed of pretreated comminuted cellulosic fibrous material and liquid is led into a digester for producing chemical pulp;

b) the material is treated in the digester with treatment chemical for producing pulp ad black liquor;

c) the black liquor is discharged from the digester at a first temperature and a first pressure;

d) the black liquor is treated in a flash tank for producing flashed black liquor and flash steam at a second temperature and a second pressure, which are lower than the first temperature and pressure;

e) the flashed black liquor is led into further treatment to the evaporation plant;

f) the flash steam is led to an indirect heat exchange contact with clean liquid in a reboiler for boiling the liquid and for generating steam;

g) the steam formed in stage f) is led from the reboiler into a fan or compressor for increasing the steam pressure to a third pressure, which is higher than the second pressure and for regulating the pressure in the flash tank in stage d), and h) steam at a third pressure is used for pretreating comminuted cellulosic fibrous material, such as chips, prior to stage a).

In stage g) the pressure of the steam being discharged from the fan or compressor and the pressure of the steam in the flash tank is regulated according to the requirement for the steam needed in the chip pretreatment.

According to the present invention, the steam discharge line of the vapor reboiler is provided with a compressor or a fan, whereby the black liquor can be flashed in the flash tank to almost atmospheric pressure. Then the temperature of the black liquor is typically slightly over 100° C. (typically approximately 106° C.) and the pressure in the flash tank approximately 20 kPa (g). According to the present invention, the use of a compressor or a fan in the discharge line of the reboiler decreases the pressure in the flash tank and the reboiler. Decreasing the pressure in the flash tank and increasing the pressure of the steam being led to the treatment of chips typically allows flashing evaporation of hot liquors such that the temperature of the produced steam is lower and the amount of steam higher than in prior art methods. A lower pressure e.g. facilitates a lower temperature of the cooled black liquor being led to evaporation. For instance, the temperature of the steam and liquid in the flashing tank can be decreased by means of the present invention by at least 5° C. and preferably at least 10° C. compared to prior art (without a compressor/fan). Simultaneously the amount of produced gas (steam) can typically increase by at least 10%, preferably at least 20% and in some cases more than 40% compared to prior art.

The advantage of the present invention becomes most obvious when the cooking temperature is low, whereby the temperature of the black liquor exiting the digester is low, such as below 145° C. This is typical e.g. when pulp is cooked in the digester to a high kappa number (typically kappa number over 50 for soft wood and over 25 for hard wood). The temperature of the black liquor can be lower than usual also when the production is low in view of the volume of the digester. At present hard wood is typically cooked also at low cooking temperatures.

The solution according to the invention is advantageous also when under cold conditions, such as in winter, the chips are cold, even frozen, and thus the steam consumption is high in order to heat the chips. Under winter conditions the flash steam is not enough for heating the chips, but live low pressure steam must be added into the chip bin in current process solutions.

Although the term flash tank is used in this description, the term also used by professionals in the field, a person skilled in the art also knows that the term covers any apparatus, wherein the pressure of hot, pressurized liquid is decreased and liquid is allowed to evaporate, typically very fast, in a closed container for producing a source of steam and liquid at a lower temperature.

DESCRIPTION OF THE DRAWING

FIG. 1 illustrates schematically a system according to the invention.

DETAILED DESCRIPTION OF PREFERRED EMBODIMENTS

FIG. 1 illustrates a system for producing steam at a digester plant and for treating black liquor such that the heat economy of the cooking process is improved. A fiber line system comprises a chip bin 10, wherein wood chips or other cellulosic material introduced via line 11 are steamed with steam obtained from line 12. Live steam can be introduced via line 12', if needed. Exhaust gases from the chip bin in line 50 are treated in a separation device 49 for removing debris, such as slivers and saw dust. Via line 13 (white liquor) and line 14 (return circulation from the digester) liquid is added for forming a suspension, after which the suspension is pressurized with a pump 15 (this zone is also referred to as feed system). Then follows a continuous digester 17 (this zone is also referred to as cooking system). Prior to the digester the suspension can alternatively be fed for treatment into a treatment vessel or vessels (can be an impregnation vessel, pre-hydrolysis vessel or other vessels, not shown). The suspension of chips and cooking liquid is fed via line 16 to the top of the digester 17, whereto also steam 31 is added. The FIGURE illustrates the components only that are important in view of the invention, and the cooking system can naturally comprise also other types of chip steaming or feed circulation or digester circulations. The digester 17 comprises two or more screen arrangements 18, 19 and 20. The digester comprises a circulation line 21 in connection with a screen 19. Black liquor is discharged from the screen 19 to circulation line 21, whereto cooking liquor is added via line 22 and liquor via line 23. Line 21 also comprises a heater 24. Filtrate from pulp washing is led via line 25 and further via lines 26 and 27 into the digester. Filtrate can also be added into the white liquor via line 28 and into pulp being discharged from the digester in line 30 via line 29.

Black liquor discharged from the digester and having a temperature of typically 120-160° C. and a solids content of 12-17% is discharged via screens 18 and 20 and led via lines 32 and 33 into a flash tank 34. In the flash tank the pressure of the black liquor is decreased for producing flash steam and for producing flashed black liquor, the solids content of which increases in the flashing. The flashed black liquor is led via line 35 to the evaporation plant of the mill, where the black liquor is concentrated to a high solids content prior to combustion in a recovery boiler. The discharge line can have a heat exchanger 36 and a fiber filter 37.

The flash steam is led via line 38 into a reboiler 39, wherein the energy contained therein is recovered. The steam is set in an indirect heat exchange contact with "clean" liquid free of volatile compounds for heating the liquid to a temperature exceeding the boiling temperature for producing clean steam. The reboiler is preferably a falling film tube reboiler. Flash steam is condensed inside the tubes, while clean liquid boils on the outer surface of the tubes for producing clean steam. The amount of produced steam is increased when the side of the clean steam is set to underpressure by means of a fan. The decreased pressure in the clean steam side ensures that more heat can be obtained from the black liquor, which heat itself releases a greater amount of steam.

The steam is discharged via line 45/12, which according to a substantial feature of the invention is provided with a pressure increasing device 41, which is a fan or a compressor. Steam is introduced into the fan from the reboiler, the pressure of the steam is increased so that the pressure and the temperature are adequate for heating the chips in the bin 10. By means of the pressure increasing device, such as a fan, the amount of steam produced in the flash tank can be increased.

The black liquor has typically been pressurized in the digester to a pressure of 5-15 bar (abs) and its temperature corresponds to the temperature of cooking treatment (approximately 110°-180° C.). Especially preferably the invention is applied for cases where the temperature of the liquor discharged from the digester is below 145° C. The structure of the flashing tank 34 is substantially conventional, and it is provided with a feed opening 42 for hot, pressurized black liquor, a discharge opening 44 for flash-evaporated steam and a discharge opening 43 for cooled black liquor having a lower pressure. Flash tanks are typically operated so that the pressure prevailing in them is lower than the pressure of black liquor led thereto, typically approximately 1-4 bar (abs). Flash tanks are containers designed for this purpose, which facilitate the pressure decrease of hot, pressurized black liquor, whereby liquid, typically water, is vaporized from the black liquor very quickly, into steam, whereby also the concentration of waste cooking chemical and the products of a cooking reaction (dissolved solids) is increased. The steam produced in this quick evaporation is discharged via a steam discharge opening 44 into line 38 at a pressure prevailing in the tank 34, e.g. 1-4 bar (abs) and at a saturation temperature corresponding to the prevailing pressure, e.g. 100°-140° C. After flashing evaporation the remaining liquid, which typically also is at a temperature of approximately j 100°-140° C. settles onto the bottom of the tank 34, wherefrom it is discharged from a discharge opening 43 via line 35. Typically the remaining liquid is led into the evaporation system.

Steam in line 12 is used for steaming introduced wood chips. The pressure required for this steam is typically determined based on the pressure requirements of the final object of application in chip steaming. According to the present invention, however, increasing the pressure of steam in line 45 by means of a fan 41 to a desired pressure level (in line 12) facilitates the production of steam in line 45 at a lower pressure Thereby, the flash tank 34 and reboiler 39 can be operated at a lower temperature, whereby in accordance with the invention more steam can be produced in the flash tank and the reboiler, at a lower steam temperature. Thereby, also the temperature of the black liquor being discharged from the flash tank into line 35 is lower and the solids content higher.

The pressure increasing device, such as a fan 41, is typically provided with rotation speed control or guide vane control. The fan is controlled with a pressure indication control 52, which receives the control signal from a pressure sensor 54 located in the flash tank 34. The pressure of the steam in the flash tank 34 and the reboiler 39 is typically the same as the pressure of the steam fed into the fan, although a minor pressure loss typically takes place between the flash tank and the line 45, caused by the equipment and piping. When the need for steam in the chip bin increases or decreases, the rotation speed of the fan is increased or decreased correspondingly. Correspondingly, also the temperature and solids content of black liquor going to the evaporation plant can be adjusted, especially the solids content can be increased.

The clean liquid is led via line 40 into the reboiler 39. It can typically comprise condensate from an evaporator, demineralized water, boiler feed water or adequately clean water fraction, such as e.g. hot water of the mill. The clean steam produced in the reboiler contains a substantially smaller amount of non-condensable gases than steam produced by direct flashing of black liquor. Clean steam in line 45/12 is preferably used for wood chips preheating by means of steam, e.g. in the chip bin 10. When this steam is used for treating chips, a less amount of volatile compounds are generated for collection and treatment by the NCG-system of the mill, since said steam does not bring volatile compounds into the pre-steaming process.

Flash steam from the black liquor flash tank contains volatile compounds, such a sulfur compounds. These compounds enter the foul condensate and into the stream of concentrated non-condensable gases, CNCG, generated in the reboiler. The foul condensate is sent from the reboiler via line 46' to the evaporation plant where it is treated in a manner known per se. Cleaner foul condensate is led via line 46, e.g. to pulp washing. The CNCG stream is led via line 47 to the condenser 48.

EXAMPLE

The starting point is that the temperature of black liquor from the digester entering the flash tank is 136° C. The pressure in the flash tank is 100 kPa (g). Then the temperature of the liquor exiting the tank is 121° C. and the solids content 14.7%. 225 kg low pressure steam/Adt pulp has to be introduced into the chip bin.

By installing a fan or compressor downstream of the reboiler, the pressure in the flash tank can be reduced to 20 kPa (g). The temperature of the exiting black liquor is then 106° C. and the solids content 15.2%. The reboiler produces an adequate amount of steam into the chip bin and no low pressure steam is required there.

The present invention provides at least the following advantages:

- Reduced need for live steam for chip heating. Additionally, the amount of steam is easy to adjust by means of a fan/compressor in accordance with the amount of steam required.
- The overall heat economy of the mill is improved, since the solids content of discharged black liquor being led to the evaporation plant is increased. The steam consumption and capacity requirement of the evaporation plant are decreased. The investment costs of the evaporation plant are decreased due to decreased capacity requirement.
- Expensive so-called boiler water is saved.

Reduced detrimental odors (compared to the use of flash steam).

Reduced explosion risks (compared to the use of flash steam).

The invention claimed is:

1. A method for producing steam at a digester plant of a chemical pulp mill, the method comprises:

a) a suspension formed of pretreated comminuted cellulosic fiber material and liquid is fed into a digester for producing chemical pulp;

b) the pretreated comminuted cellulosic fiber material is treated in the digester with a treatment chemical for producing the chemical pulp and black liquor;

c) the black liquor is discharged from the digester at a first temperature and a first pressure;

d) the black liquor is treated in a flash tank which produces flashed black liquor and flash steam at a second temperature and a second pressure, which are lower than the first temperature and the first pressure;

e) the flashed black liquor is fed to an evaporation plant;

f) the flash steam is fed to a reboiler in which the flash steam is in indirect heat exchange contact with a clean liquid in the reboiler which boils the clean liquid and generates;

g) the steam formed in step f) is fed from the reboiler into a fan or compressor which increases a pressure of the steam to a third pressure, which is higher than the second pressure and regulates the second pressure of the steam in the flash tank in step d); and h) the steam at the third pressure is applied to heat the comminuted cellulosic fiber material before the pretreated comminuted cellulosic fiber material is fed to the digester.

2. The method according to claim 1, wherein in step g) the third pressure of the steam being discharged from the fan or compressor and the second pressure of the steam in the flash tank are adjusted according to a requirement for steam in the pretreatment of the comminuted cellulosic fiber material.

3. The method according to claim 1, wherein the digester produces high kappa pulp.

4. The method according to claim 1, wherein the temperature of the black liquor discharged from the digester is below 145° C.

5. An arrangement for producing steam at a digester plant of a chemical pulp mill, said arrangement comprising:

a vessel configured to steam a cellulosic fiber material;

a feed system in which a suspension of cellulosic fiber material and liquid is formed and the suspension is pressurized;

a continuous digester configured to digest the suspension, which digester is connected to a black liquor conduit configured to discharge the black liquor stream from the digester;

a flash tank connected to said black liquor conduit, and in which the pressure of the black liquor is decreased for producing flashed black liquor and flash steam, whereby the flash tank is provided with a conduit for discharging the flashed black liquor and feeding the flashed black liquor to an evaporation plant of the chemical pulp mill;

a flash steam conduit for feeding the flash steam from the flash tank to a reboiler, in which clean steam is generated due to an indirect heat exchange relationship with the flash steam and a clean liquid; and a steam conduit for feeding the clean steam generated in the reboiler into the steaming vessel, whereby the steam conduit includes a fan or a compressor which increases a pressure of the clean steam generated in the reboiler.

6. The arrangement according to claim 5, wherein the fan or compressor is connected to a pressure indicator controller which receives a pressure signal from a pressure sensor located in the flash tank.

7. The arrangement according to claim 5, wherein at least one vessel for treating the suspension is arranged between the feed system and the digester.

8. A method to produce steam comprising:

feeding a suspension of pretreated comminuted cellulosic fiber material and liquid into a digester vessel in a chemical pulp mill;

adding a treatment chemical to the pretreated comminuted cellulosic fiber material in the digester vessel;

converting the pretreated comminuted cellulosic fiber material to pulp in the digester vessel, wherein the conversion produces black liquor;

discharging the black liquor form the digester vessel;

flashing the discharged black liquor in a flash tank and discharging from the flash tank flash steam and flashed black liquor;

feeding the flashed black liquor to an evaporation plant in the chemical pulp mill;

feeding the flash steam to a heat exchanger and transferring heat energy from the flash steam to vaporize a clean liquid to produce clean steam;

increasing the pressure of the clean steam to a pressure greater than a pressure of the flash steam when discharged from the flash tank, wherein the increase of the pressure of the clean steam is performed using a fan or centrifugal compressor and the amount of the increase in the pressure is based on a requirement for steam to pretreatment the comminuted cellulosic fiber material; and after increasing the pressure of the clean steam, pretreating comminuted cellulosic fiber material with the clean steam to produce the pretreated comminuted cellulosic fiber material fed to the digester vessel.

9. The method of claim 8 wherein the heat exchanger is included with a reboiler and the reboiler transfers heat to contribute to the vaporization of the clean liquid.

10. The method of claim 9 wherein the reboiler is a falling film tube reboiler.

11. The method of claim 8 wherein the steps of the method are performed continuously.

12. The method of claim 8 further comprising applying suction from a fan to a clean steam discharge port of the heat exchanger to draw the clean steam from the heat exchanger.

13. The method of claim 8 wherein the digester vessel is a continuous digester vessel.

14. The method of claim 8 further comprising regulating the pressure of the flashed steam in the flash tank.

15. The method of claim 8 further comprising controlling the fan or centrifugal compressor based on information indicating a pressure of the flashed steam in the flash tank, wherein the information indicating the pressure is provided by a pressure indicator controller which receives a signal from a pressure sensor located in the flash tank.

* * * * *